US012692779B2

(12) United States Patent
Blake et al.

(10) Patent No.: US 12,692,779 B2
(45) Date of Patent: Jul. 28, 2026

(54) DOWNHOLE INSTRUMENT WITH ANGULAR RATE SENSOR

(71) Applicant: Icefield Tools Corporation, Whitehorse (CA)

(72) Inventors: Erik Blake, Whitehorse (CA); Emmanuel Potvin, Whitehorse (CA); Mark Pollard, Whitehorse (CA)

(73) Assignee: Icefield Tools Corporation, Whitehorse (CA)

( * ) Notice: Subject to any disclaimer, the term of this patent is extended or adjusted under 35 U.S.C. 154(b) by 0 days.

(21) Appl. No.: 19/423,343

(22) Filed: Dec. 17, 2025

(65) Prior Publication Data

US 2026/0110245 A1 Apr. 23, 2026

Related U.S. Application Data

(60) Provisional application No. 63/735,247, filed on Dec. 17, 2024.

(51) Int. Cl.
*E21B 47/024* (2006.01)

(52) U.S. Cl.
CPC ..... *E21B 47/024* (2013.01)

(58) Field of Classification Search
CPC ..... E21B 47/022; E21B 47/024; E21B 47/00; F16M 11/123; G01C 15/00
See application file for complete search history.

(56) References Cited

U.S. PATENT DOCUMENTS

| | | | |
|---|---|---|---|
| 4,345,454 | A | 8/1982 | Brown |
| 4,981,283 | A | 1/1991 | Bradshaw et al. |
| 5,272,922 | A | 12/1993 | Watson |
| 5,657,547 | A | 8/1997 | Uttecht et al. |
| 6,347,282 | B2 | 2/2002 | Estes et al. |
| 6,712,159 | B2 | 3/2004 | Estes et al. |
| 7,353,613 | B2 | 4/2008 | Bartel et al. |
| 7,481,109 | B2 | 1/2009 | Moore et al. |
| 8,065,087 | B2 | 11/2011 | Ekseth et al. |
| 8,374,793 | B2 | 2/2013 | Ekseth et al. |

(Continued)

FOREIGN PATENT DOCUMENTS

| | | | |
|---|---|---|---|
| CA | 393039 | A | 12/1940 |
| CN | 109212648 | A | 1/2019 |

(Continued)

*Primary Examiner* — Daniel P Stephenson
(74) *Attorney, Agent, or Firm* — Nathan V. Woodruff

(57) ABSTRACT

A downhole instrument includes an instrument housing, a sensor yoke rotatably mounted within the instrument housing, and an angular rate sensor carried by the sensor yoke. A first rotational stop is mounted to the instrument housing that defines a first rotational position of the sensor yoke. A second rotational stop mounted to the instrument housing defines a second rotational position of the sensor yoke that is rotationally spaced from the first rotational position. A differential screw may be connected to the second rotational stop that is adapted to adjust a position of the second rotational position. A torsion coupling may be coupled between the rotational driver and the sensor yoke, where the torsion coupling is energized by the motor that rotates the sensor yoke with a returning force that resists movement of the sensor yoke away from the first rotational stop.

20 Claims, 6 Drawing Sheets

(56) References Cited

U.S. PATENT DOCUMENTS

| | | | | |
|---|---|---|---|---|
| 2005/0022402 | A1* | 2/2005 | Ash | E21B 47/022 33/321 |
| 2005/0126022 | A1* | 6/2005 | Hansberry | E21B 47/022 33/313 |
| 2013/0118731 | A1* | 5/2013 | Parfitt | G01P 1/02 166/250.01 |
| 2014/0090888 | A1* | 4/2014 | Smith | E21B 34/025 175/38 |
| 2015/0052988 | A1* | 2/2015 | Price | E21B 49/003 73/152.17 |
| 2016/0145997 | A1* | 5/2016 | Van Steenwyk | E21B 47/022 33/304 |
| 2020/0132458 | A1 | 4/2020 | Johnson | |
| 2022/0220841 | A1* | 7/2022 | Pell | E21B 47/017 |

FOREIGN PATENT DOCUMENTS

| | | | |
|---|---|---|---|
| EP | 0391045 | A2 | 10/1990 |
| EP | 1308707 | A1 | 5/2003 |
| WO | 2020222043 | | 11/2020 |

* cited by examiner

DOWNHOLE INSTRUMENT WITH ANGULAR RATE SENSOR

TECHNICAL FIELD

This relates to a downhole instrument with angular rate sensor, namely, a downhole instrument with an angular rate sensor having a reversible position with improved accuracy.

BACKGROUND

In geotechnical applications, such as mining and oil and gas, it is often necessary to make measurements of a borehole trajectory during or after a hole is drilled. These measurements are made using an inclinometer, which measures inclination and azimuth of the borehole. Sometimes these measurements are made at specific depths while the instrument is at rest, sometimes referred to as static stations, and sometimes measurements are made dynamically while the instrument is drawn through the borehole.

Borehole survey instruments are typically slim cylindrical instruments designed to fit into narrow boreholes. They may be powered by batteries, through wires connected to a surface power supply, or by downhole generators (for example, powered by fluid circulating through the borehole).

Borehole survey instruments have an internal coordinate system against which sensors are referenced and calibrated. Typically, the Z-axis points along the long axis of the cylindrical housing and the X- and Y-axes are perpendicular to the long axis, although other coordinate systems may be used.

Measurements of inclination are often made with inclinometers or accelerometers with reference to the Earth's gravitational field. These measurements are relatively straightforward and can be accomplished using a variety of sensors. In modern equipment, MEMS (micro-electromechanical systems) sensors are preferred as they have low power requirements and are small and rugged. Using MEMS sensors, it is easy to provide 3 orthogonally mounted sensors that permit measurement of inclination at all instrument attitudes.

Measurements of azimuth may be made using magnetic or inertial sensors relative to the Earth's magnetic field or spin axis, respectively. In the latter case, a variety of gyroscopes and angular rate sensors may be used to measure the fraction of the Earth's spin rate (about 15 deg/hr) observed along the instrument's internal coordinate system axes. With knowledge of the instrument's inclination, which may be obtained from accelerometers that may also be carried by the instrument, and geographical latitude, calculations may be made to determine the azimuth of the instrument long axis, and hence the borehole.

Angular rate sensors all exhibit noise and bias drift issues that affect their ability to accurately-measure small fractions of a small rotation rate signal. MEMS sensors in particular have bias drift and angular random walk (ARW) characteristics that can mask the smaller Earth rotation signals. A common approach to removing bias in measurements is to take a pair of measurements using the same equipment but reversing the measurement direction. This indexing method for bias removal has a long history. For example, Delambre and Méchain, charged with defining the length of the metre on their 1792-1799 North-South expedition through France, used a reversing telescope mounted to a horizontal graduated dial. Reversed measurements were made for each triangulation angle in order to remove bias from the dial.

U.S. Pat. No. 4,981,283 (Bradshaw et al.) is an example of an angular rate sensor for a borehole survey instrument that uses indexing to improve the performance.

SUMMARY

According to an aspect, there is provided a downhole instrument, comprising an instrument housing, a sensor yoke rotatably mounted within the instrument housing, the sensor yoke having a pivot axis, and an angular rate sensor carried by the sensor yoke. A first rotational stop is mounted to the instrument housing, the first rotational stop defining a first rotational position of the sensor yoke. A second rotational stop is mounted to the instrument housing, the second rotational stop defining a second rotational position of the sensor yoke that is rotationally spaced from the first rotational position. A differential screw is connected to the second rotational stop and adapted to adjust a position of the second rotational position, the differential screw having a first pitch and a second pitch, wherein a differential between the first pitch and the second pitch define an effective pitch that is less than the first pitch and the second pitch.

According to other aspects, the downhole instrument may include one or more of the following features, alone or in combination: the differential screw may adjust a position of the second rotational stop relative to the instrument housing; a locking screw may selectively lock the second rotational stop in a desired second rotational position; the angular rate sensor may comprise a sensitive axis that is reversed in the second rotational position relative to the first rotational position; the differential screw may be adapted to adjust the position of the second rotational position such that the second rotational position is 180 degrees separated from the first rotational position; the sensor yoke may carry a stop block that engages the first rotational stop in the first rotational position and the second rotational stop in the second rotational position; the instrument housing may have a longitudinal axis, and the pivot axis may be perpendicular to the longitudinal axis. The downhole instrument may include a torsion coupling as discussed in the aspects below.

According to an aspect, there is provided a downhole instrument, comprising an instrument housing, and an angular rate sensor carried by a sensor yoke, the sensor yoke being rotatably mounted to the instrument housing such that the sensor yoke rotates about a pivot axis that is perpendicular to the longitudinal axis, A first rotational stop is mounted to the instrument housing, the first rotational stop defining a first rotational position of the sensor yoke. A second rotational stop is mounted to the instrument housing, the second rotational stop defining a second rotational position of the sensor yoke. A rotational driver is connected to rotate the sensor yoke. A torsion coupling is coupled between the rotational driver and the sensor yoke. The rotational driver is configured to rotate the sensor yoke to the first rotational position and energize the torsion coupling with a returning force that resists movement of the sensor yoke away from the first rotational stop.

According to other aspects, the downhole instrument may include one or more of the following features, alone or in combination: the rotational driver may be configured to rotate the sensor yoke to the second rotational position and energize the torsion coupling with a returning force that resists movement of the sensor yoke away from the second rotational stop; the rotational driver may comprise an electric motor, the electric motor having a powered state and an unpowered state, wherein the electric motor may be configured to rotate the sensor and energize the torsion coupling in the powered state, and switch to the unpowered state after the torsion coupling is energized; the rotational driver may be a motor that is coupled to the torsion coupling by a gear reducer, the motor and the gear reducer having sufficient friction and inertia to resist the returning force of the torsion coupling; the angular rate sensor may comprise a sensitive axis, and wherein the sensitive axis is reversed in the first rotational position relative to the second rotational position; the sensor yoke may comprise a stop block that engages the first rotational stop in the first rotational position and the second rotational stop in the second rotational position; the instrument housing may have a longitudinal axis, and the pivot axis may be perpendicular to the longitudinal axis. The downhole instrument may include a differential screw as described in the aspects above.

According to an aspect, there is provided a method of operating a downhole instrument, the downhole instrument comprising an instrument housing, a sensor a sensor yoke rotatably mounted within the instrument housing about a pivot axis, and an angular rate sensor carried by the sensor yoke. The method comprises the steps of: switching a rotational driver from an unpowered state to a powered state to cause the sensor yoke to rotate to a first rotational position in which the sensor yoke engages a first rotational stop that is fixed relative to the instrument housing, and to energize a torsion coupling that is coupled between the rotational driver and the sensor yoke; and after energizing the torsion coupling, switching the rotational driver to the unpowered state, wherein, with the rotational driver in the unpowered state, a returning force of the torsion coupling resists movement of the sensor yoke away from the first rotational position.

The method may further comprise one or more of the following aspects, alone or in combination: the method may further comprise the steps of switching the rotational driver from the unpowered state to the powered state to rotate the sensor yoke to the second rotational position in which the sensor yoke engages a second torsion coupling, and to energize the torsion coupling, and switching the rotational driver to the unpowered state thereafter; the sensor yoke may comprise a stop block that engages the first rotational stop in the first rotational position and the second rotational stop in the second rotational position; the rotational driver may comprise an electric motor, wherein, in the powered state, an electrical current is applied to the electric motor, and in the unpowered state, an electrical current is not applied to the electric motor; the rotational driver may be a motor that is coupled to the torsion coupling by a gear reducer, the motor and the gear reducer having sufficient friction and inertia to resist the returning force of the torsion coupling; the angular rate sensor may comprise a sensitive axis, and wherein the sensitive axis is reversed in the first rotational position relative to the second rotational position.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

In this discussion, a coordinate system in which the Z-axis points along the long axis of the cylindrical housing and the X- and Y-axes are perpendicular to the long axis will be used. Other coordinate systems may be used with appropriate changes to the calculations and measurements described below.

"2D" Borehole Survey Tools

Tools using two angular rate sensors, with their sensitive axes aligned with the X- and Y-axes of the instrument can be implemented by mounting the sensors on a rotatable carriage that can be indexed at two positions 180 degrees apart. By indexing at 90 degrees, it is possible to make measurements along the X- and Y-axes using only one sensor. The rotation axis of the carriage, upon which the angular rate sensor(s) is/are mounted, is parallel to the long axis of the instrument.

Instruments having Earth-rate measurements only along their X- and Y-axes are generally unable to determine azimuth reliably at near-horizontal positions (i.e. with the Z-axis of the instrument near-horizontal), particularly in the East-West direction. This is because the third Earth rotation axis measurements (i.e., along the instrument's Z-axis) are missing.

"3D" Borehole Survey Tools

In order to make a measurement of Earth rotation rate projected onto the Z-axis of the instrument, the sensor may be indexed such that its sensitive axis points first along the positive Z-axis and then along the negative Z-axis. In other words, the axis of rotation for the sensor is perpendicular to the long axis of the instrument.

In the confines of a narrow borehole survey instrument, designing a mechanism that can accurately rotate a sensor by 180 degrees, and maintain this position during measurements, may be difficult to achieve.

Rotation about the cross-axis may be achieved by using a small direct-drive motor mounted on the cross axis, or by using a bevel gear to change the direction of an axial motor by 90 degrees onto the cross axis. It is even possible to connect the rotatable carriage to the cross axis, thereby driving all three indexed sensor axes with a single motor.

Figure 1:
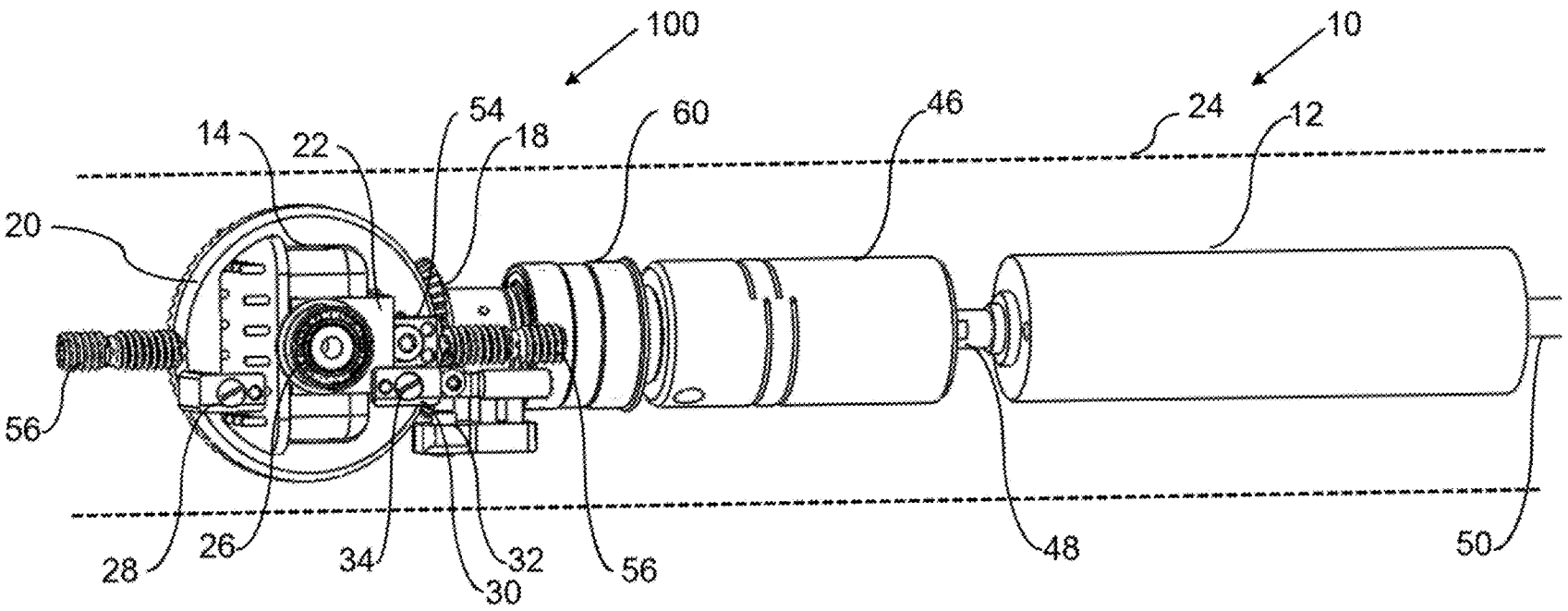
FIG. 1 is a perspective view of a downhole instrument.
Figure 7:
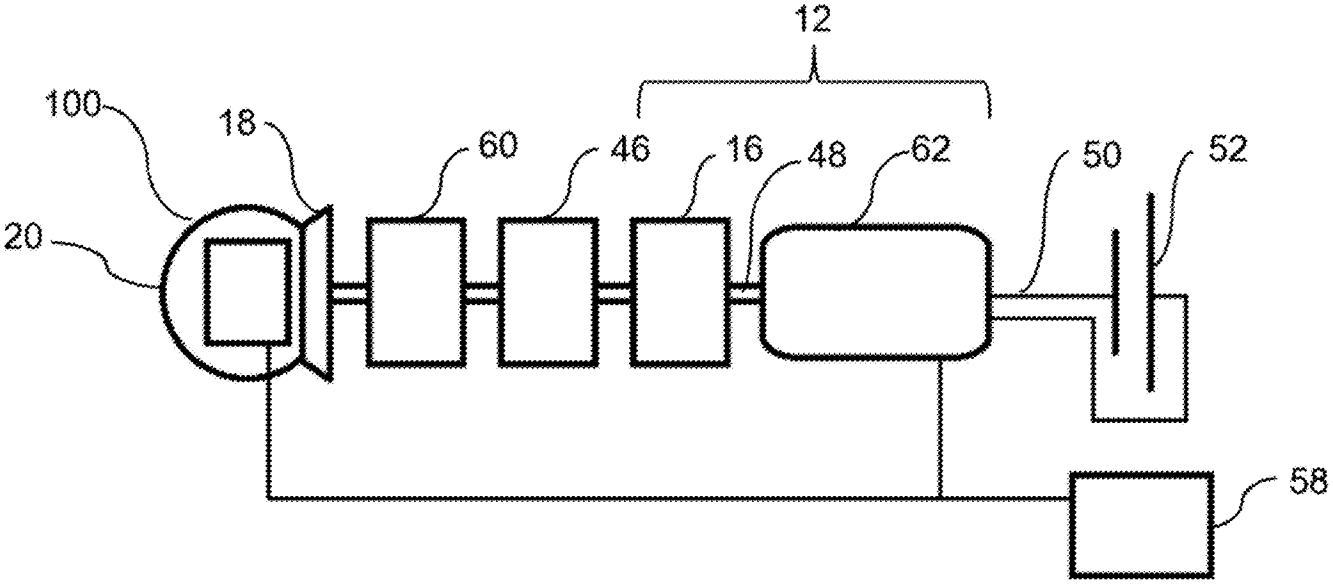
FIG. 7 is a block diagram of a system for controlling the downhole instrument.

Referring to FIG. 1, a dedicated drive 12 is used to drive an angular rate sensor 14, which in this example acts as a Z-axis sensor, to its indexed measurement positions. Referring to FIG. 7, drive 12 may include an electric motor 62, such as a small servo motor, that drives a planetary-gear speed reducer 16, which in turn drives the sensor assembly 100. Referring to FIG. 1, sensor assembly 100 has a bevel gear 20 that is driven by a bevel gear 18. Bevel gear 20 is carried by a cross-mounted yoke 22 holding angular rate sensor 14. Referring to FIG. 1, there may also be a torsion coupling 46 as discussed in more detail below and, where necessary, a bearing assembly 60 between drive 12 and bevel gear 18. Drive 12 and the components between drive 12 and sensor assembly 100 may vary based on a given implementation.

As the discussion below relates to controlling the position of angular rate sensor 14, the depicted example has been simplified by excluding the X- and Y-sensors or the carriage, which may be considered to be part of the instrument housing 24.

Rotational Positions

The discussion below relates to obtaining more accurate measurements form an angular rate sensor 14 with more than one rotational position. As this was developed int eh context of a Z-axis sensor, the example herein will be discussed in the context of a Z-axis sensor 14 and sensor yoke 22 that has a first measurement position, or home position shown in FIG. 2, and a second measurement position, or reverse position shown in FIG. 3. The second measurement position is achieved by rotating sensor yoke 22 about the cross-axis, defined by shaft and bearings 26, by 180 degrees relative to the first measurement position.

Referring to FIG. 1, as shown, the home position of the Z-axis sensor yoke is defined by a first rotational stop 28, represented by a machined anvil, and against which yoke 22 turns when it moves to the home position. The reverse position is defined by a second rotational stop 30, represented by a second machined anvil.

Position Calibration

Figure 3:
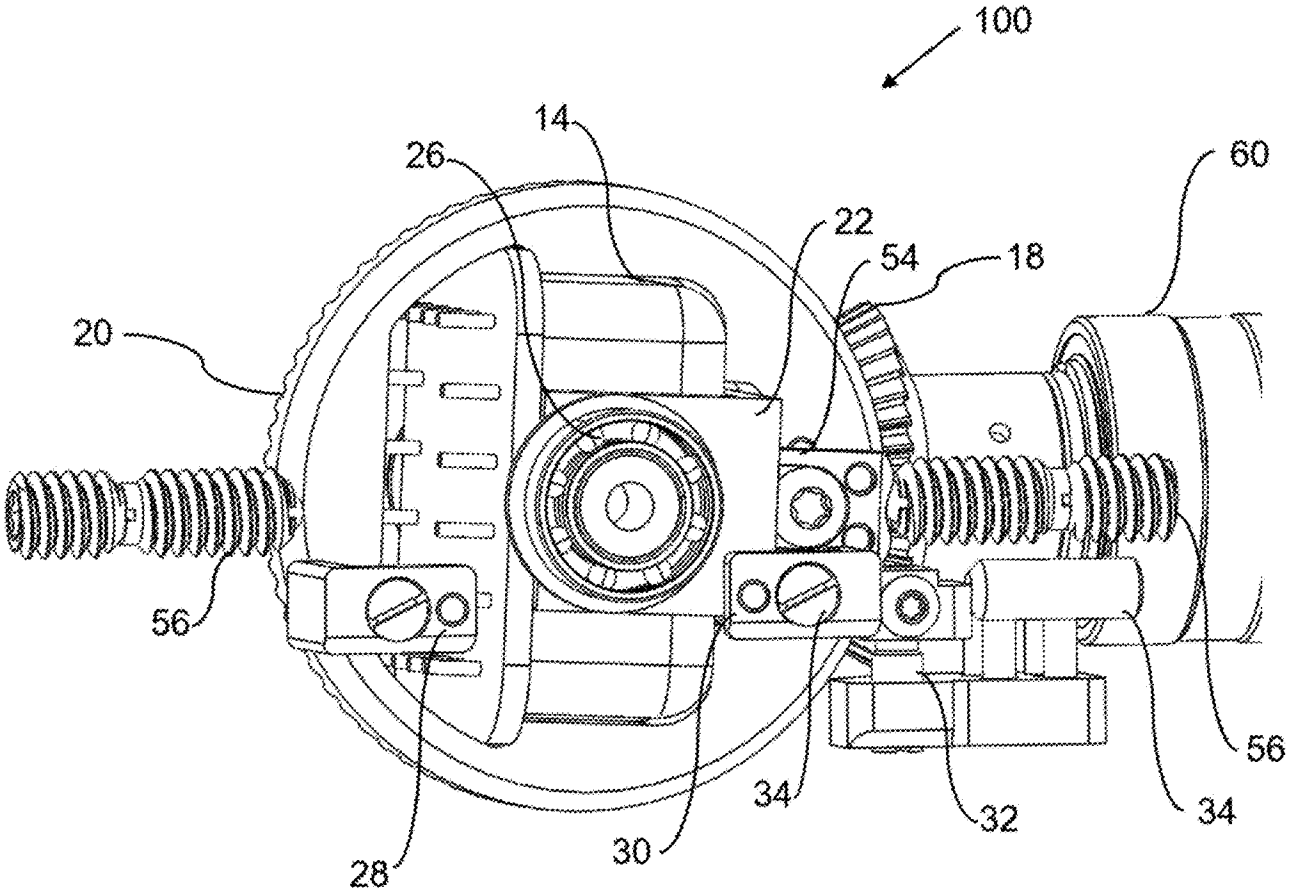
FIG. 3 is a detailed perspective view of a downhole instrument with a sensor yoke in a second position.
Figure 4:
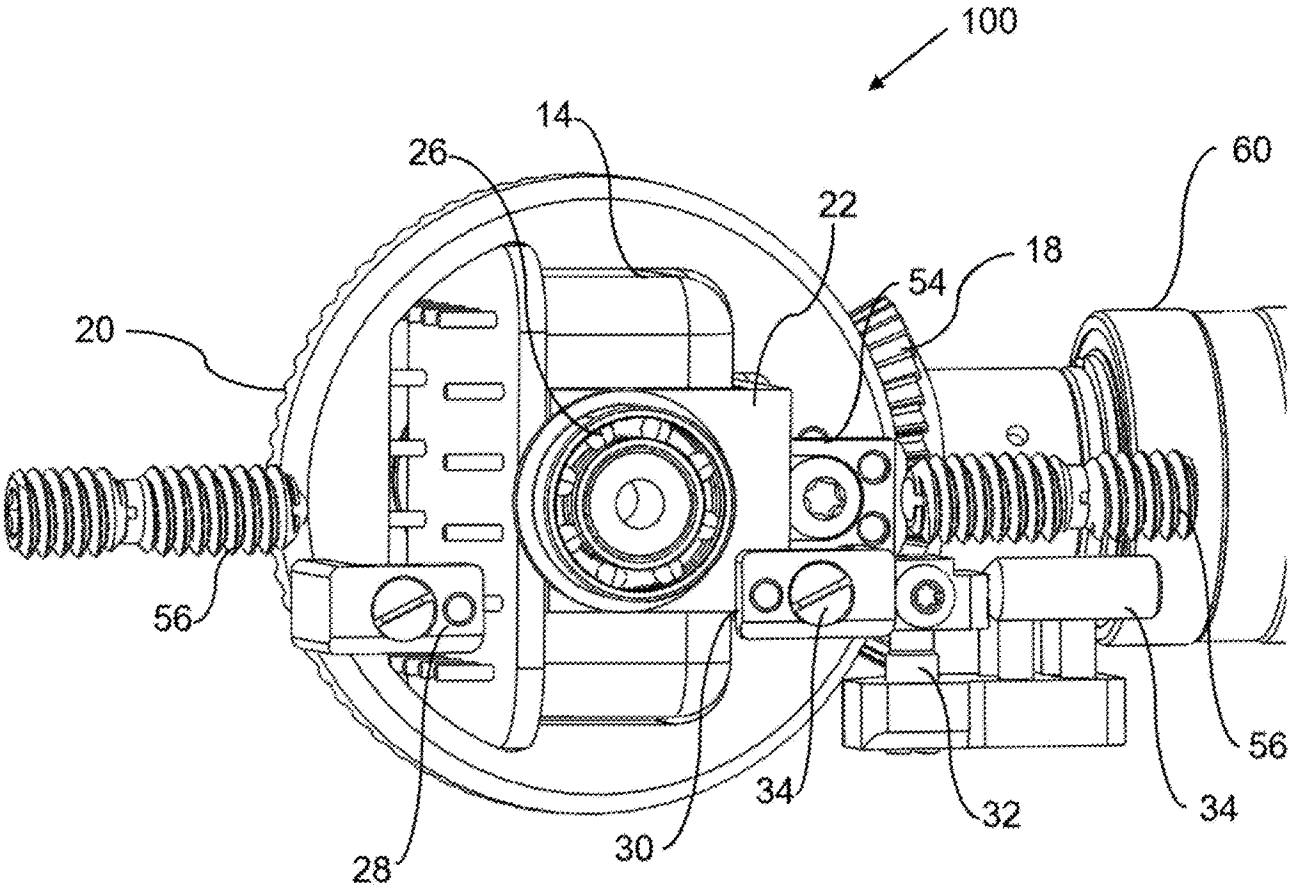
FIG. 4 is a detailed perspective view of a downhole instrument with a sensor yoke in an adjusted second position.

In one example, referring to FIGS. 3 and 4, second rotational stop 30 may be adjustable by a differential screw 32 that adjusts the position of second rotational stop 30. This allows the rotation angle of sensor yoke 22 between first anvil 28 and second anvil 30 to be set as close to 180 degrees as tolerances permit. Once adjusted to the desired position, second adjustable anvil 30 may be locked in place using set screws 34 or other locking mechanism. This calibration may be done during assembly of the tool and then fixed in place for deployment after assembly. In the depicted example, second anvil 30 is adjustable, while first anvil 28 is fixed. It will be understood that either or both anvils 28 and 30 may be adjustable, however, for the purposes of ensuring a precise spacing of 180 degrees between rotational positions, a single adjustable rotational stop is generally sufficient.

Figure 6:
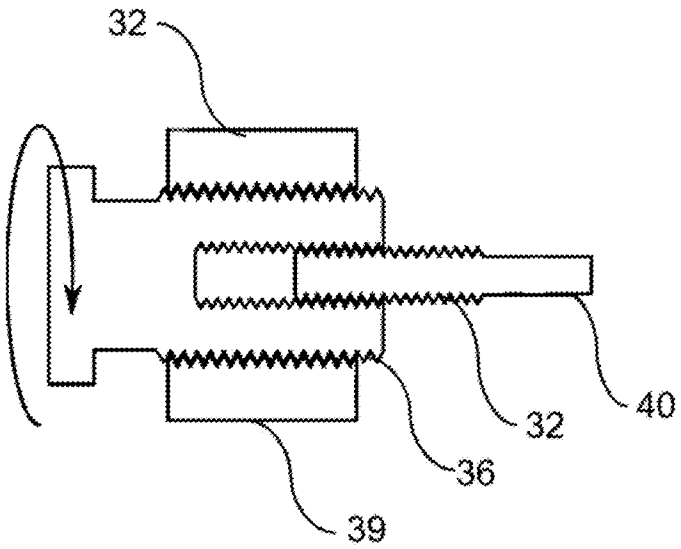
FIGS. 5 and 6 are examples of differential screws.
Figure 5:
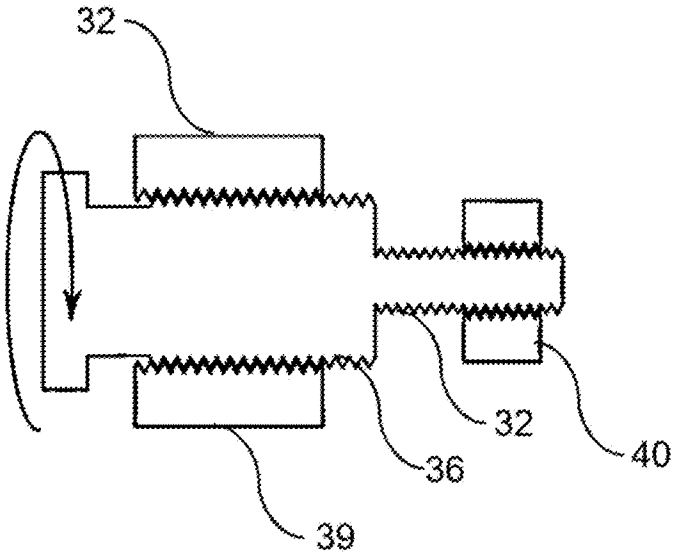

In the depicted example, the adjustment of second anvil 30 is effected using differential adjustment screw 32, such as a dual-pitch screw, examples of which are shown in FIGS. 5 and 6. Dual-pitch screw 32 has a first threaded section 36 with a first pitch, and a second threaded section 38 with a second pitch. First threaded section 36 engages an anchor 39 or fixed body, while second threaded section 38 either engages or moves a moveable body 40. Examples of dual-pitch screws are shown in FIG. 5, where moveable body 40 moves along second threaded section 38, and FIG. 6, where differential screw 32 has a two-part design, with second threaded section 38 received within first threaded section 36. In both cases, the difference in the pitch of first and section threaded sections 36 and 38 allows for a finer adjustment in the position of moveable body 40 than could be achieved using a traditional single-pitch screw. In both examples, the effective pitch of the screw 32 is proportional to the inverse of the difference between the inverses of the two screw pitches. In this manner, a much smaller effective pitch of the adjustment screw is able to be achieved than would otherwise be practical to machine, and therefore a more precise adjustment to the position of second anvil 30 may be achieved. In the depicted example, comparing FIGS. 5 and 6 to FIG. 2, anchor 39 may be instrument housing 24, moveable body 40 may be second anvil 30. As differential screw 32 is acted up, second rotational stop 30 moves from the position shown in FIG. 3 to the position shown in FIG. 4.

Holding Against the Stop During Measurement

As noted above, referring to FIG. 1, drive 12 is used to rotate sensor yoke 22. As shown, drive 12 may connect to sensor yoke 22 via bearings bevel gears 18 and 20 to convert the rotational movement of drive 12 about a longitudinal axis into the desired rotational movement of sensor yoke 22 about bearings 26 that define an axis that is perpendicular to the longitudinal axis of drive 12. The bevel gears include a yoke bevel gear 20 that rotates with yoke 22, and a drive bevel gear 18 that is rotated by drive 12. The depicted drive mechanism is convenient to achieve the desired movement within the design constraints of a particular application, and may vary as is known in the art.

To achieve more accurate readings, instrument 10 is designed to hold sensor yoke 22 stationary, or as stationary as possible, during measurements by applying a force to hold sensor yoke 22 against first anvil 28 and/or second anvil 30. In the depicted example, a torsion coupling 46 is coupled between drive 12 and sensor yoke 22, or more particularly, between gear reducer 16 and drive bevel gear 18. When drive 12 rotates sensor yoke 22 against an anvil 28 or 30, a small amount of torsion is developed in torsion coupling 46. When drive 12 is turned off, the stored torsion in torsion coupling 46, together with the innate rotational friction of the drive mechanism, which may include the friction between bevel gears 18 and 20, in gear reducer 16, and within motor 12, resists the return force of torsion coupling 46 and results in a force that holds sensor yoke 22 in contact with anvil 28 or 30, and therefore in the desired position for the measurement. This also allows drive 12 to be deactivated, which may be used to reduce power usage and/or reduce electrical noise that may effect readings taken by sensor 14. Torsion coupling and the rotational friction of gear reducer 16, etc. may be designed to ensure a sufficient amount of force is applied to overcome any external forces that may be applied to sensor yoke 22 while measurements are being taken, which may vary depending on a given application. Torsion coupling 46 may be a coupling that includes a material that undergoes elastic deformation when a force is applied, and that applies a returning, torsional force in response, such as a steel spring, elastomeric material, etc. . . . Torsional coupling 46 may be double-acting, in that it applies a force in both directions, such that it is able to hold yoke 22 against both first and second anvils 28 and 30. The stiffness of torsional coupling 46 may be selected such that a sufficient torsional force is developed against the appropriate anvil 28 and 30 without otherwise affecting the movement of sensor yoke 22. It may be possible to design torsional coupling 46 such that a torsional force is only developed in one direction if a holding force is only desired to be applied against one anvil 28 or 30. The rotational friction of gear reducer 16 may be enhanced by the gear ratio, which may be designed to step down the rotational speed of drive 12 when driving sensor yoke 22. In reverse, the gear ratio enhances the rotational friction and inertia of gear reducer 16 and drive 12 that acts against the returning force of tortional coupling 46. These factors may be taken into account to ensure an appropriate amount of force is applied by torsional coupling 46 to sensor yoke 22 in order to maintain it against anvil 28 and/or 30.

The use of torsional coupling 46 allows drive motor mechanism to be activated or powered when necessary to rotate sensor yoke 22, and deactivated or unpowered once the selected rotary position is achieved. This may be used to reduce the amount of power consumed, the amount of heat generated, and the amount electromagnetic interference that may otherwise be generated by drive 12. Reducing the amount of power consumed may be beneficial when the instrument is battery-powered. Reducing the amount of heat generated may be beneficial when deployed in high temperature environments, such as in geothermal or certain oilfield applications, where instrument 10 may be deployed inside a thermal flask to insulate instrument 10 from high external temperatures. In this situation, instrument 10 generates heat as it consumes power, which serves to increase the temperature of the instrument within the flask, thereby reducing the useful life or deployment time of instrument 10. In some drive motors 12, the electronic commutation of the servo motor windings by the drive motor electronics may result in significant or non-trivial levels of electromagnetic interference. It has been found that, even with careful shielding, it may be difficult to exclude the motor commutation noise from the measurement circuitry and therefore degrade the measurement quality. This may be reduced or avoided by deactivating drive 12 while measurements are being taken.

Example

Referring to FIG. 1, there is shown an example of a downhole instrument 10. Downhole instrument 10 has a housing 12 that is sized and adapted to be inserted into a downhole tubing string or within a sensor sub (not shown). Housing 12 houses an earth rate sensor 14 that is carried by a rotating sensor yoke 22. Sensor yoke 22 is rotatably mounted within housing 12 on a shaft with bearings 26, which defines a rotational axis that is perpendicular to the longitudinal axis of housing 12, which is designed to be aligned with the borehole, tubing string, etc. In this manner, earth rate sensor 14 is able to be moved between 0-degree and 180-degree positions, shown in FIG. 1-3, as discussed above. Sensor yoke 22 includes a first bevel gear 20, or a yoke bevel gear, that is engaged by a second bevel gear 18, or a drive bevel gear. Drive bevel gear 18 is driven by motor 12, which rotates a drive shaft 48 (shown in FIG. 7) that is parallel to the longitudinal axis of housing 12 and supported by a drive shaft bearing (not shown). Bevel gears 18 and 20 translate this rotational movement to rotate sensor yoke 22 about bearings 26 that define an axis that is perpendicular to the housing axis. Drive 12 is attached to a gear reducer 16, and a torsion coupling 46 is connected between gear reducer 16 and drive bevel gear 18 supported by bearing 46. Referring to FIG. 7, drive 12 may be connected by wires 50 to a battery 52 as shown, or may be connected to an external power source, including a power source at the surface, downhole generator, etc.

Figure 2:
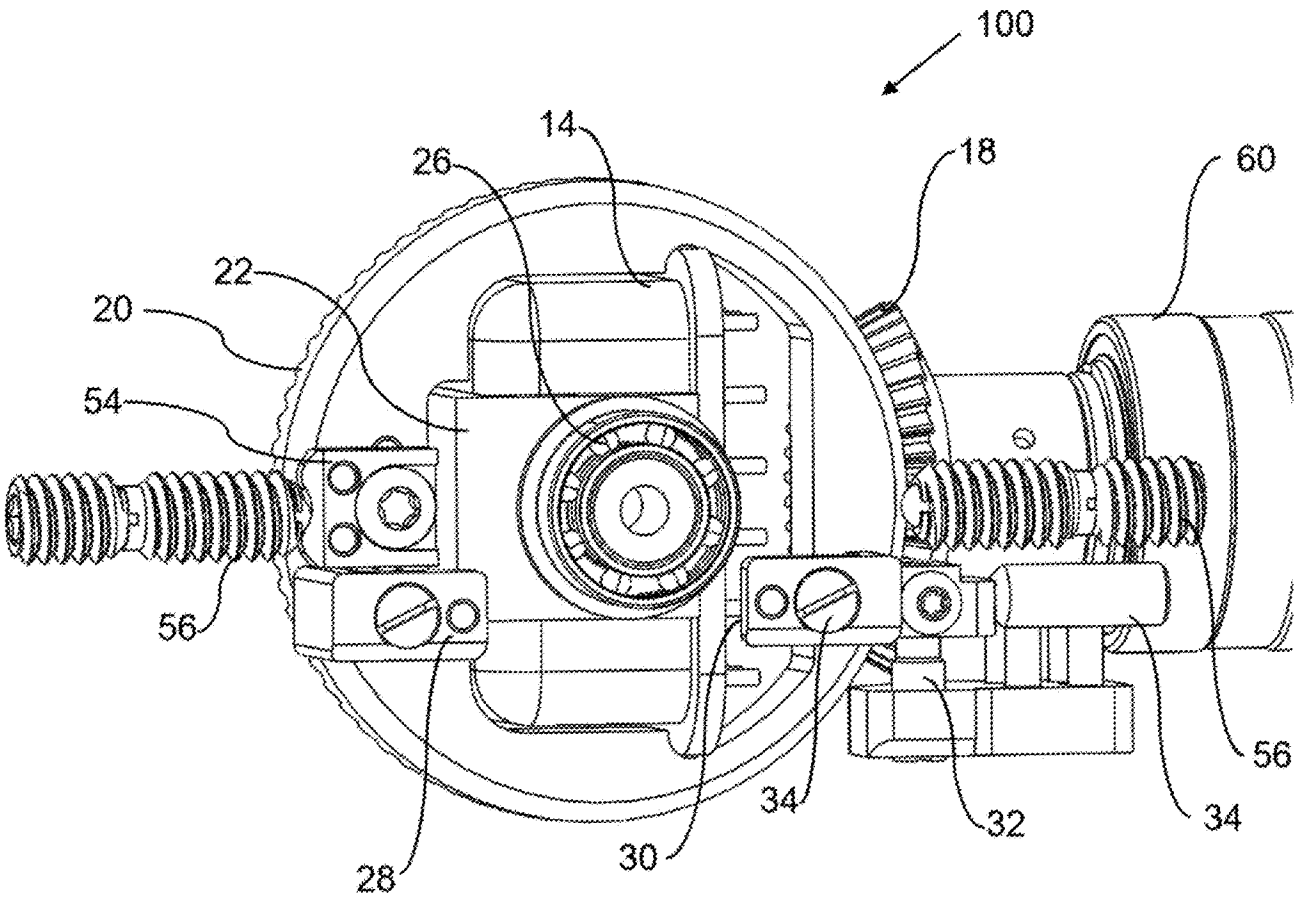
FIG. 2 is a detailed perspective view of a downhole instrument with a sensor yoke in a first position.

Referring to FIG. 2, sensor yoke 22 carries a stop block 54 such that, as sensor yoke 22 is rotated, stop block 54 engages first anvil 28 that defines a first rotational position, and second anvil 30 as shown in FIG. 4 that defines a second rotational position that is rotated 180 degrees from the first rotational position. In order to properly define the rotational positions, one anvil may be fixed, such as anvil 28, and the other anvil may be adjustable, such as anvil 30. Ball spring plungers 56 on either side of yoke 42 may be provided that engage detentes carried by stop block 54 to hold sensor yoke 22 in a desired rotational position. Ball spring plungers 56 may be used to supplement the torsion mechanism described below, but may also produce shock waves that may damage sensors.

To increase the accuracy of the separation of the rotational positions, the position of adjustable anvil 30 may be adjusted, such as while calibrating instrument 10. Adjustable anvil 30 may be adjusted using a differential screw 32 from a position shown in FIG. 3 to the position shown in FIG. 4. Differential screw 32, as shown, provides more fine control of the position of adjustable anvil 30. Once the desired position is achieved, locking screws 34 may be engaged to secure adjustable anvil 30 in position. As depicted locking screws 34 engage differential screw 32 and adjustable anvil 30.

As drive 12 drives sensor yoke 22 to either the first or second rotational position, additional torsion may be applied to torsion coupling 46, which may be downstream of gear reducer 16. When motor 12 is deactivated, the rotational friction of the drive elements such as gear reducer 16, drive shaft bearings, motor 12, etc., in combination with the gear ratio, resists movement at one end of torsion coupling 46, while the torsion stored within torsion coupling 46 causes the other end to continue to apply rotational force to sensor yoke 22 and hold it in position against the relevant anvil 28 and/or 30.

Referring to FIG. 7, a controller 58 may be used that controls motor 12 and that collects readings from rate sensor 14. Separate controllers 58 may be used, and controller 58 may be used to perform different roles, such as controlling other components and collecting readings from other sensors. Controller 58 may switch motor 12 between a powered state and an unpowered state, such as by disconnecting battery 52, where, in the powered state an electrical current powers motor 12 and in the unpowered state, the electrical current is not applied to motor 12.

Other sensors (now shown) may be carried within or adjacent to the housing and used in conjunction with the earth rate sensor.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A downhole instrument, comprising:

an instrument housing;

an angular rate sensor carried by a sensor yoke, the sensor yoke being rotatably mounted to the instrument housing such that the sensor yoke rotates about a pivot axis that is perpendicular to the longitudinal axis;

a first rotational stop mounted to the instrument housing, the first rotational stop defining a first rotational position of the sensor yoke;

a second rotational stop mounted to the instrument housing, the second rotational stop defining a second rotational position of the sensor yoke;

a rotational driver that is connected to rotate the sensor yoke; and a torsion coupling coupled between the rotational driver and the sensor yoke;

wherein:

the rotational driver is configured to rotate the sensor yoke to the first rotational position and energize the torsion coupling with a returning force that resists movement of the sensor yoke away from the first rotational stop.

2. The downhole instrument of claim 1, wherein the rotational driver is further configured to rotate the sensor yoke to the second rotational position and energize the torsion coupling with a returning force that resists movement of the sensor yoke away from the second rotational stop.

3. The downhole instrument of claim 1, wherein the rotational driver comprises an electric motor, the electric motor having a powered state and an unpowered state, wherein the electric motor is configured to rotate the sensor and energize the torsion coupling in the powered state, and switch to the unpowered state after the torsion coupling is energized.

4. The downhole instrument of claim 1, wherein the rotational driver is a motor that is coupled to the torsion coupling by a gear reducer, the motor and the gear reducer having sufficient friction and inertia to resist the returning force of the torsion coupling.

5. The downhole instrument of claim 1, wherein the angular rate sensor comprises a sensitive axis, and wherein the sensitive axis is reversed in the first rotational position relative to the second rotational position.

6. The downhole instrument of claim 1, wherein the sensor yoke comprises a stop block that engages the first rotational stop in the first rotational position and the second rotational stop in the second rotational position.

7. The downhole instrument of claim 1, wherein the instrument housing has a longitudinal axis, and the pivot axis is perpendicular to the longitudinal axis.

8. A method of operating a downhole instrument, the downhole instrument comprising an instrument housing, a sensor a sensor yoke rotatably mounted within the instrument housing about a pivot axis, and an angular rate sensor carried by the sensor yoke, the method comprising the steps of:

switching a rotational driver from an unpowered state to a powered state to cause the sensor yoke to rotate to a first rotational position in which the sensor yoke engages a first rotational stop that is fixed relative to the instrument housing, and to energize a torsion coupling that is coupled between the rotational driver and the sensor yoke;

after energizing the torsion coupling, switching the rotational driver to the unpowered state, wherein, with the rotational driver in the unpowered state, a returning force of the torsion coupling resists movement of the sensor yoke away from the first rotational position.

9. The method of claim 8, further comprising the steps of switching the rotational driver from the unpowered state to the powered state to rotate the sensor yoke to the second rotational position in which the sensor yoke engages a second torsion coupling, and to energize the torsion coupling, and switching the rotational driver to the unpowered state thereafter.

10. The method of claim 9, wherein the sensor yoke comprises a stop block that engages the first rotational stop in the first rotational position and the second rotational stop in the second rotational position.

11. The method of claim 8, wherein the rotational driver comprises an electric motor, wherein, in the powered state, an electrical current is applied to the electric motor, and in the unpowered state, an electrical current is not applied to the electric motor.

12. The method of claim 8, wherein the rotational driver is a motor that is coupled to the torsion coupling by a gear reducer, the motor and the gear reducer having sufficient friction and inertia to resist the returning force of the torsion coupling.

13. The method of claim 8, wherein the angular rate sensor comprises a sensitive axis, and wherein the sensitive axis is reversed in the first rotational position relative to the second rotational position.

14. A downhole instrument, comprising:

an instrument housing;

a sensor yoke rotatably mounted within the instrument housing, the sensor yoke having a pivot axis;

an angular rate sensor carried by the sensor yoke;

a first rotational stop mounted to the instrument housing, the first rotational stop defining a first rotational position of the sensor yoke;

a second rotational stop mounted to the instrument housing, the second rotational stop defining a second rotational position of the sensor yoke that is rotationally spaced from the first rotational position; and a differential screw connected to the second rotational stop and adapted to adjust a position of the second rotational position, the differential screw having a first pitch and a second pitch, wherein a differential between the first pitch and the second pitch define an effective pitch that is less than the first pitch and the second pitch.

15. The downhole instrument of claim 14, wherein the differential screw adjusts a position of the second rotational stop relative to the instrument housing.

16. The downhole instrument of claim 14, further comprising a locking screw that selectively locks the second rotational stop in a desired second rotational position.

17. The downhole instrument of claim 14, wherein the angular rate sensor comprises a sensitive axis that is reversed in the second rotational position relative to the first rotational position.

18. The downhole instrument of claim 17, wherein the differential screw is adapted to adjust the position of the second rotational position such that the second rotational position is 180 degrees separated from the first rotational position.

19. The downhole instrument of claim 14, wherein the sensor yoke carries a stop block that engages the first rotational stop in the first rotational position and the second rotational stop in the second rotational position.

20. The downhole instrument of claim 14, wherein the instrument housing has a longitudinal axis, and the pivot axis is perpendicular to the longitudinal axis.

* * * * *